US006242999B1

(12) United States Patent
Nakayama et al.

(10) Patent No.: US 6,242,999 B1
(45) Date of Patent: Jun. 5, 2001

(54) RESISTOR

(75) Inventors: Shogo Nakayama, Kadoma; Seiji Tsuda, Fukui; Akio Fukuoka, Sabae, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/233,429

(22) Filed: Jan. 20, 1999

(30) Foreign Application Priority Data

Jan. 20, 1998 (JP) ..... 10-008314

(51) Int. Cl.[7] ..... H01C 1/012
(52) U.S. Cl. ..... 338/309; 338/307; 338/328
(58) Field of Search ..... 338/308, 309, 338/307, 313, 328

(56) References Cited

U.S. PATENT DOCUMENTS 4,613,844 * 9/1986 Kent et al. ..... 338/314
4,659,435 * 4/1987 Brother et al. ..... 204/1 T
4,684,916 * 8/1987 Ozawa ..... 338/308
4,910,643 * 3/1990 Williams ..... 361/414
5,287,083 * 2/1994 Person et al. ..... 338/332
5,785,879 * 7/1998 Kawamura et al. ..... 216/95

FOREIGN PATENT DOCUMENTS 61-047859 * 3/1986 (JP) .
2-110903 * 4/1990 (JP) .
3-62901 * 3/1991 (JP) .
7-176402 7/1995 (JP) .

* cited by examiner

*Primary Examiner*—Lincoln Donovan
*Assistant Examiner*—Kyung S. Lee
(74) *Attorney, Agent, or Firm*—Parkhurst & Wendel, L.L.P

(57) ABSTRACT

A pair of upper electrode layers 12, connected to resistor layer 14, is formed with a gold system electro-conductive material containing glass frit on the side portion towards the edge of the upper surface of substrate 11. The adhesive strength of which electrode layer to the substrate 11 is strong enough and the electrode layer withstands a thermal stress and a corrosive environment. A resistor thus manufactured maintains its superior electrical characteristics with a high operational reliability even in the harsh operating environment where there is a thermal amplitude lasting for a long term, in a corrosive atmosphere, etc.

9 Claims, 3 Drawing Sheets

RESISTOR

BACKGROUND OF THE INVENTION

The present invention relates to a resistor for use in a high density wiring circuit.

A chip resistor disclosed in the Japanese Patent Laid-open No. 3-62901 may be cited as an example representing the conventional resistors. In the following, the conventional resistor is described in the order of manufacturing process steps with reference to FIG. 8 which shows the cross sectional structure.

A pair of base electrodes 3 are formed at both ends of an insulating ceramic chip substrate 2; by printing a pattern with a gold resin paste which contains gold as the metal organic material, using a known photo etching process or a screen printing process, and baking it in an approximate temperature of 850° C. The thickness of the base electrode 3 film formed is thin, because the metal organic material used here contains more organic components relative to metal components. The use of the above paste leads to an advantage of saving in gold consumption, and therefore a reduction of manufacturing cost.

A resistor film 4 is formed by printing a pattern with a Ru group paste with each of the respective ends overlapped to the pair of base electrodes 3, using a known screen printing process and baking it in an approximate temperature of 850° C. As the base electrodes 3 have been formed with a conductive material containing gold and glass frit a gold system material, diffusion of silver to the resistor film 4, which is observed when the electrode is made of a silver group material, does not occur. Therefore, there is no deterioration in the electrical characteristics of the resistor film 4.

In order to alleviate possible influence of trimming operation, to be made in a subsequent process step, on the resistor film 4, a glass undercoat is applied in the form of an undercoat film 5 on the resistor film 4. The resistor film 4 can be a thin film resistor of Ni—Cr system alloy, Ni—Cr—Al system alloy, Ni—Cr—Fe system alloy, etc. formed through a deposition or other such process. In this case, the undercoat film 5 is not provided.

Then, an Ag resin paste 6, which being an electro-conductive resin material having a thermo-setting temperature of between 150–250° C. and a strong adhesive property to an inorganic material, is applied to cover the entire surface of the base electrodes 3, and baked. If in this case an electro-conductive film of Ag or Ag/Pd is formed on the base electrodes 3 by a high-temperature baking process of approximately 850° C., the electrical characteristics may be affected at the boundary region. This is a why such an electro-conductive resin material of low baking temperature is used. Film thickness of the base electrode 3 is as thin as several hundred Å. The covering with the Ag resin paste 6 improves electrical contact between the base electrode 3 and a measuring groove during the trimming operation. The covering is useful also to cover up a weakness of the gold-containing base electrode 3 since it easily wears.

The resistance is adjusted to a certain specific value by a known trimming method. An overcoat film 8 is formed over the resistor film 4 in order to protect it from adverse environments during the forthcoming plating process and in the actual operating conditions. An end face electrode 7 is formed at both ends of the chip substrate 2. The face electrode 7 is then plated to form a plating film 9, and a finished chip resistor is completed.

In the above described conventional resistor, however, the film thickness after baking of the base electrode 3 is very thin because it uses a metal resin paste to avoid the deterioration of resistor film 4 in electrical characteristics, and the adhesion to substrate 2 is weak. Therefore, if a resistor undergoes a thermal amplitude for a certain time period the base electrode 3 itself may have cracks causing a substantial shift in the resistance value, or in a worst case the electrical continuity is broken.

Furthermore, because the electric conduction between the end face electrode 7 and the resistor film 4 is made via the Ag resin paste 6, when a resistor is used in a sulfidizing ambient, a chlorinating ambient or in other strong corrosive environments, the film of Ag resin paste may be corroded creating a broken electric conduction with the resistor film 4, or a substantial shift in the resistance value. The Ag resin paste 6 is normally covered by the plating film 9 so as not to be exposed to the outside in the actual operating conditions, a stress due to the thermal history of soldering often causes a gap between the plating film 9 and the overcoat film 8 rendering the Ag resin paste 6 exposed to the outer surface. The Ag resin paste 6 may then be corroded.

SUMMARY OF THE INVENTION

The present invention aims to present a highly reliable resistor which maintains superior electrical characteristics, even when it is used in a harsh environment such as a corrosive ambient, or an environment where there is a long lasting thermal amplitude, etc.

The invented resistor comprises a substrate, an upper electrode layer of a gold system material containing a glass frit provided on a side towards an edge of the upper surface of the substrate, a resistor layer formed bridging the upper electrode layers with a part of its respective ends overlapping to each of the electrode layers, and a protection layer which covers at least the resistor layer.

In the above described structure, because a gold system material containing a glass frit is used for the upper electrode layer, the adhesion to substrate is strong enough and the film is sufficiently thick; so, the resistance value shift is hardly observed even if it undergoes a thermal amplitude.

In the invented resistor, it is preferred to provide another upper electrode layer which covers a part or the whole of the surface of the upper electrode layer. By so doing, the reliability in electric connection of the upper electrode layer with a barrier layer and an end face electrode is improved, and the reliability during the use in a corrosive ambient is also improved.

When the following conditions are fulfilled, the invented resistor will have an additional operational reliability; namely, the amount of the glass frit in the gold system material is within a range 10–30% by volume, the layer thickness of the upper electrode layer is within a range 5–15 $\mu$m, the upper electrode layer is formed in the shape of a letter T, L or H, another upper electrode layer is provided in the side, other than the end face, of the substrate covering a part of the upper electrode layer, the protection layer is made of a resin group material, the another upper electrode layer is made of an electro-conductive resin material, an end face electrode is provided on the entire side surface, or in the upper part of the side surface, of the substrate end face keeping electric connection with the upper electrode layer, and other such conditions.

DESCRIPTION OF THE PREFERRED EMBODIMENTS

Preferred embodiments of the present invention are described in the following with reference to the drawings.

(Embodiment 1)

Figure 1:
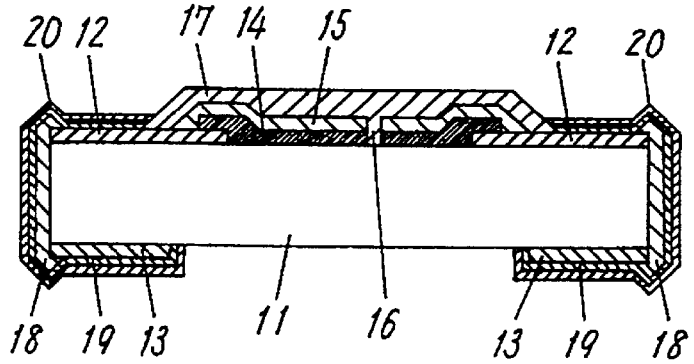
FIG. 1 shows a cross sectional view of a resistor in accordance with embodiment 1 of the present invention.
Figure 2A:
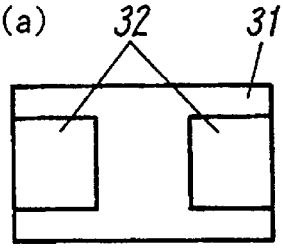
FIG. 2(*a*)–FIG. 2(*f*) are plane views used to describe the manufacturing process steps of a resistor in accordance with embodiment 1 of the present invention.
Figure 2E:
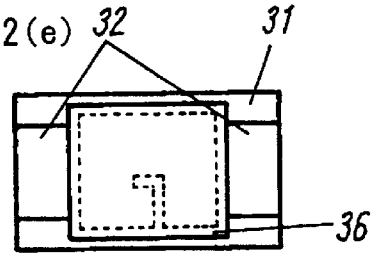
Figure 2B:
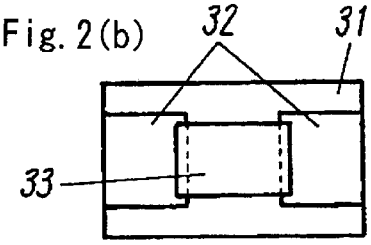
Figure 2F:
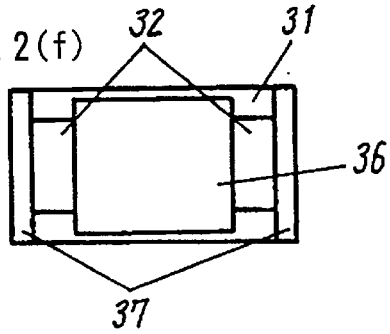
Figure 2C:
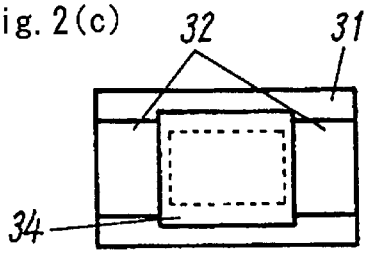
Figure 2D:
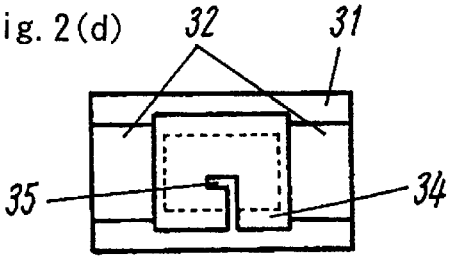

An invented resistor of embodiment 1 as shown in FIG. 1 comprises a pair of upper electrode layers 12 made of a gold system material containing glass frit, provided on the respective sides towards an edge of the upper surface of ceramic substrate 11 made of alumina or other such material. Depending on the needs, a pair of lower electrode layers 13 made of a mixed material of silver and glass are provided on the respective sides on the bottom surface of substrate 11. Provided on the upper surface of substrate 11 is a resistor layer 14 made of a mixed material of ruthenium oxide and glass (or a mixed material of silver-palladium and glass), disposed so as a part of it is overlapped with the upper electrode layer 12 for electrical connection. A precoat layer 15 of borosilicate lead glass is provided to cover at least the resistor layer 14. For adjusting the resistance to a certain specific value, a trimming trench 16 is formed through the precoat layer 15 and the resistor layer 14 by a cutting process using a laser or other means. In addition, a protection layer 17 of borosilicate lead glass is provided covering at least the resistor layer 14.

An end face electrode 18 made of a mixed material of silver and glass is provided, when necessary, at a side of the substrate 11 for electric connection between the upper electrode layer 12 and the lower electrode layer 13. A first plating layer 19 of nickel is provided to cover the exposed portions of the end face electrode 18, the upper electrode layer 12 and the lower electrode layer 13; in addition, a second plating layer 20 is provided, depending on the needs, covering the first plating layer 19.

Now in the following, a method for manufacturing the resistor is described with reference to FIG. 2(*a*)–FIG. 2(*f*).

As shown in FIG. 2(*a*), a paste of gold system material containing glass frit is screen-printed at both side portions of a substrate 31 made of alumina, etc. so as to reach to the edge, which are then baked in an approximate temperature of 850° C. to form a pair of upper electrode layers 32. If the content of glass frit is less than 10% by volume, the adhesion to substrate 31 is low; whereas the resistance value of upper electrode layer 32 goes high when it exceeds 30% by volume. Therefore, a preferred content of glass in the gold system paste is 10–30% by volume. If the thickness of the upper electrode layer 32 is less than 5 μm, the resistance value of the electrode layer 32 is high. On the other hand, if the thickness is greater than 15 μm, it creates unstable contact between the upper electrode layer 32 and the resistor layer 33, which is provided in a later stage, because of a difference in the level between the substrate 31 and the upper electrode layer 32. This invites an increased consumption of gold material and an increased manufacturing cost. Therefore, film thickness of the upper electrode layer 32 is preferably within a range of 5–15 μm.

Depending on the needs, a pair of lower electrode layers (not shown) may be formed in both sides on the bottom surface of substrate 31, by screen-printing a mixed paste of silver and glass materials and then baking it in an approximate temperature of 850° C.

And then, as shown in FIG. 2(*b*), a resistor layer 33 is formed; by screen-printing a mixed paste of ruthenium oxide and glass on the upper surface of substrate 31 so that it overlaps with a part of the respective upper electrode layers 32 in order to provide electric connection between the upper electrode layers 32, and then it is baked at an approximate of temperature 850° C. Because the upper electrode layer 32 has been made with a gold system material, diffusion of the upper electrode material to the resistor layer 33 is less as compared where silver is used in the material for the upper electrode. Therefore, there is less deterioration in the electrical characteristics of resistor layer 33.

Then, a precoat layer 34 is formed, as shown in FIG. 2(*c*), by screen-printing a borosilicate glass paste so as to cover at least the resistor layer 33 and it is baked at an approximate temperature of 600° C.

In order to adjust the resistance value of resistor layer 33 to a certain specific value, the precoat layer 34 and the resistor layer 33 are cut by laser or other such means, as shown in FIG. 2(*d*), forming a trimming trench 35.

A protection layer 36 is formed, as shown in FIG. 2(*e*), by screen-printing a borosilicate glass paste to cover the resistor layer 33 and it is baked at approximate temperature of 600° C.

Depending on the needs, an end face electrode layer 37 is formed as shown in FIG. 2(*f*); by applying a mixed paste of silver and glass on the end surface (in terms of the length direction) of substrate 31 using a roller transfer printing method, so as to be overlapping with a part of the upper electrode layer 32, also with a part of lower electrode layer if there has been such electrode layer provided, and it is baked at an approximate temperature of 600° C.

Finally, a barrier layer (not shown) of plated nickel or other material is formed to cover the exposed portion of upper electrode layer 32 and the end face electrode layer 37. Depending on the needs, a solder layer (not shown) of tin lead alloy or other material is provided covering the barrier layer.

As a gold system material containing glass frit is used for the upper electrode layer 32 of an invented resistor in accordance with the present embodiment, it has a strong adhesive strength to the substrate 31 and the film is thick enough. Therefore, the resistance value of the resistor hardly shifts even if it undergoes a thermal amplitude, and well withstands corrosion even if it is used in a corrosive environment.

Now in the following, actual characteristics of the resistor are compared with those of the conventional.

Both the invented resistors of embodiment 1 and the conventional resistors have been put into a 1000 cycle thermal shock test, one cycle consisting of a −55° C. ambient for 30 min. and a 125° C. ambient for 30 min., and the rate of resistance value shift was measured.

Both the invented resistors of embodiment 1 and the conventional resistors have been put into a test in a corrosive ambient; where, the resistors were stored in a 96° C. ambient for 1000 hours coexisting with an oil containing a 3% sulfur, a 5% chlorine and distilled water for, and the rate of resistance value shift was measured.

Table 1 and Table 2 show the results of the thermal shock test and the corrosive ambient test, respectively. As seen from the test results, the rate of resistance value shift among the invented resistors of the present embodiment is smaller than that among the conventional resistors. This represents that the invented resistors are reliable even in harsh operating environments. Regarding other items of electrical characteristics, the invented and the conventional resistors, both using a gold system material for the electrodes connected with resistor layer, showed identical results.

TABLE 1

| | (No. of samples: 20) Rate of resistance value shift (%) | | |
|---|---|---|---|
| | Maximum | Minimum | Average |
| Embodiment 1 | 0.07 | −0.03 | 0.03 |
| Conventional | disconnection (5 pcs) | 1.7 | — |

TABLE 2

| | (No. of samples: 20) Rate of resistance value shift (%) | | |
|---|---|---|---|
| | Maximum | Minimum | Average |
| Embodiment 1 | 0.03 | −0.01 | 0.02 |
| Conventional | disconnection (5 pcs) | 3.1 | — |

Although in the above embodiment the protection layer 36 has been formed with a borosilicate lead glass material, it may be formed instead with an epoxy group or a phenol group resin material, by thermo-setting it in an approximate temperature of 200° C.

Although the end face electrode layer 37 has been formed in the above embodiment with a mixed paste material of silver and glass, it may be formed instead either with a nickel group electro-conductive resin material by applying it through a transfer printing method using a roller and thermo-setting in an approximate temperature of 180° C., or by sputtering a nickel-chromium group material.

During formation of the above described protection layer with a resin material, and the end face electrode layer with a resin material or a nickel chromium material, the resistor layer after the trimming is not exposed to a heat higher than 400° C.; therefore, there may be no shift in the resistance value of the resistor after the trimming. Thus the level of accuracy in the resistance value is improved, and the production yield rate also increases.

When a resistor is provided with the above described lower electrode layer, end face electrode layer, barrier layer and solder layer, the contact area of the resistor and land increases when mounted on a board. This contributes to a higher mounting reliability.

The end face electrode layer 37 has been provided in the present embodiment 1 to cover a whole side surface of the substrate 31. However, it may be provided covering only the upper portion of the side surface of the substrate 31. By so doing, the fillet of the resistor becomes smaller when it is mounted on a board with the protection layer 36 down. This contributes to a reduced mounting area, and an increased mounting density.

(Embodiment 2)

Figure 3:
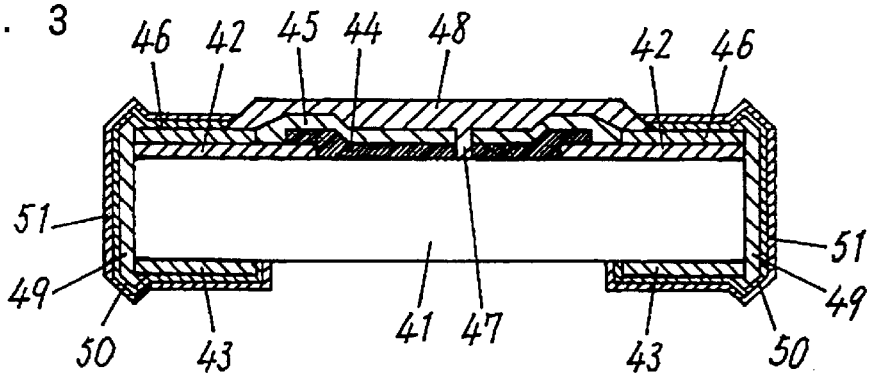
FIG. 3 shows a cross sectional view of a resistor in accordance with embodiment 2 of the present invention.
Figure 4A:
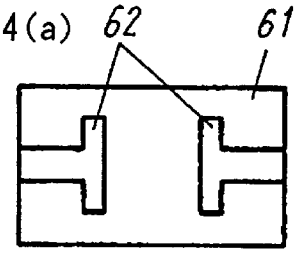
FIG. 4(*a*)–FIG. 4(*g*) are plane views used to describe the manufacturing process steps of a resistor in accordance with embodiment 2 of the present invention.
Figure 4E:
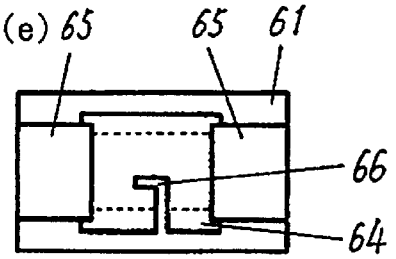
Figure 4B:
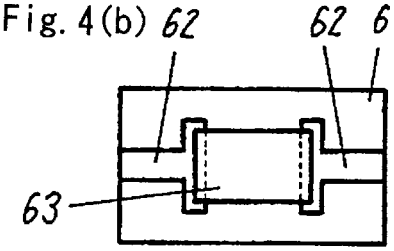
Figure 4F:
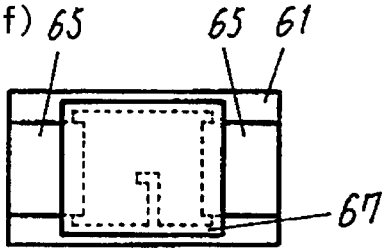
Figure 4C:
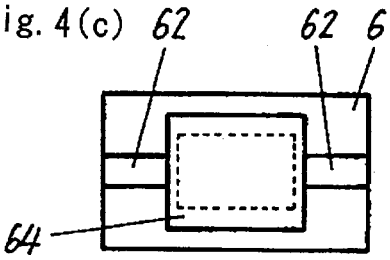
Figure 4G:
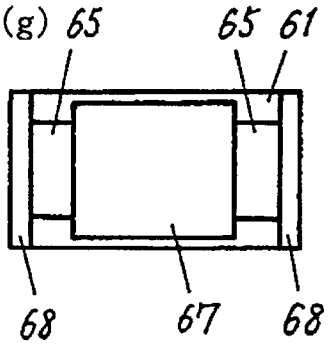
Figure 4D:
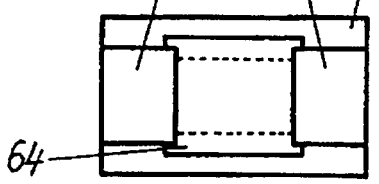

An invented resistor of embodiment 2 as shown in FIG. 3 comprises a pair of upper electrode layers 42 made of a gold system material containing glass frit, provided on the respective sides towards an edge of the upper surface of ceramic substrate 41 made of alumina or other such material. Depending on the needs, a pair of lower electrode layers 43 made of a mixed material of silver and glass are provided in the respective sides on the bottom surface of substrate 41. Provided on the upper surface of substrate 41 is a resistor layer 44 made of a mixed material of ruthenium oxide and glass (or a mixed material of silver-palladium and glass), disposed so as a part of it is overlapped with the upper electrode layer 42 for electrical connection. A precoat layer 45 of borosilicate lead glass is provided covering at least the resistor layer 44.

At both sides on the surface of substrate 41 is a pair of another upper electrode layers 46, provided so as to cover a part or the whole of the surface of upper electrode layer 42 for electric connection. For adjusting the resistance to a certain specific value, a trimming trench 47 is formed through the precoat layer 45 and the resistor layer 44 by a cutting process using a laser or other means. In addition, a protection layer 48 of borosilicate lead glass is provided covering at least the resistor layer 44.

An end face electrode 49 made of a mixed material of silver and glass is provided, when necessary, at a side of the substrate 41 for electric connection between the upper electrode layer 42 and the lower electrode layer 43. A first plating layer 50 of nickel is provided to cover the exposed portions of the end face electrode 49, the upper electrode layer 42 and the lower electrode layer 43; in addition, a second plating layer 51 is provided, depending on the needs, covering the first plating layer 50.

Now in the following, a method for manufacturing the resistor is described with reference to FIG. 4(*a*)–FIG. 4(*g*).

As shown in FIG. 4(*a*), a paste of gold system material containing glass frit is screen-printed at both side portions of a substrate 61 made of alumina, etc. so as to reach to the edge, and are then baked in an approximate temperature of 850° C. to form a pair of upper electrode layers 62. The upper electrode layer 62 may be formed in the shape of a letter T. This may save the consumption of the precious gold system material, and contribute to a lower manufacturing cost. If the content of glass frit is less than 10% by volume, the adhesion to substrate 61 is low; whereas the resistance value of upper electrode layer 62 becomes high when it exceeds 30% by volume. Therefore, a preferred content of glass in the gold system paste is 10–30% by volume. If thickness of the upper electrode layer 62 is less than 5 $\mu$m, the resistance value of the electrode layer 62 becomes high. On the other hand, if the thickness is greater than 15 $\mu$m, it creates unstable contact between the upper electrode layer 62 and the resistor layer 63, which is provided in a later stage, because of a difference in the level between the substrate 61 and the upper electrode layer 62. This at the same time invites an increased consumption of gold material and an increased manufacturing cost. Therefore, film thickness of the upper electrode layer 62 is preferably within a range 5–15 $\mu$m.

Depending on the needs, a pair of lower electrode layers (not shown) may be formed in both sides on the bottom surface of substrate 61, by screen-printing a mixed past of silver and glass materials and then baking it in an approximate temperature of 850° C.

And then, as shown in FIG. 4(*b*), a resistor layer 63 is formed; by screen-printing a mixed paste of ruthenium oxide and glass on the upper surface of substrate 61 so as it overlaps with a part of the respective upper electrode layers 62 in order to provide electrical connection between the upper electrode layers 62, and it is baked an approximate temperature of 850° C. Because the upper electrode layer 62 has been made with a gold system material, diffusion of the upper electrode material to the resistor layer 63 is less as compared with a case where silver is used in the material for upper electrode. Therefore, there is less deterioration in the electrical characteristics of resistor layer 63.

Then, a precoat layer 64 is formed, as shown in FIG. 4(*c*), by screen-printing a borosilicate glass paste so as to cover at least the resistor layer 63 and baking it in an approximate temperature of 600° C.

And then, as shown in FIG. 4(*d*), a pair of another upper electrode layers 65 are formed in both sides of the substrate 61, by screen-printing an electro-conductive silver resin paste material so it covers a part or the whole of the surface of upper electrode layer 62 for electric connection and thermo-setting in an approximate temperature of 200° C. The another upper electrode layer 65 helps a resistance measuring probe secure a contact area during the trimming operation. Although the another upper electrode layer 65 is extending to the edge portion in the present embodiment, it may be disposed instead so that the upper electrode layer 62 is exposed uncovered at the side edge. By so doing, the reliability in electric connection of the upper electrode layer 62 with a barrier layer and an end face electrode layer 68, to be provided in a later stage, may be improved, and the operational reliability of a resistor in a corrosive ambient may also be raised.

In order to adjust the resistance value of resistor layer 63 to a certain specific value, the precoat layer 64 and the resistor layer 63 are cut by laser or other such means, as shown in FIG. 4(*e*), forming a trimming trench 66.

A protection layer 67 is formed, as shown in FIG. 4(*f*), by screen-printing a borosilicate glass paste material so as to cover the resistor layer 63 and baking it in an approximate temperature of 600° C.

Depending on the needs, an end face electrode layer 68 is formed as shown in FIG. 4(*g*); by applying a mixed paste of silver and glass on the end surface (in terms of the length direction) of substrate 61 using a roller transfer printing method, so as to be overlapping with a part of the upper electrode layer 62, also with a part of lower electrode layer if there has been such electrode layer provided, and baking it in an approximate temperature of 600° C.

Finally, a barrier layer (not shown) of plated nickel or other material is formed to cover the exposed portion of upper electrode layer 62 and the end face electrode layer 68. Depending on the needs, a solder layer (not shown) of tin lead alloy or other material is provided covering the barrier layer.

As a gold system material containing glass frit is used for the upper electrode layer 62 of an invented resistor in accordance with the present embodiment, it has a strong adhesive strength to the substrate 61 and the film is thick enough. Therefore, the resistance value of the resistor hardly shifts even if it undergoes a thermal amplitude, and it well withstands corrosion even if it is used in a corrosive environment.

Even if the another upper electrode layer 65 is corroded in a corrosive environment, a stable electric connection may be secured directly without having the another upper electrode layer 65 in between, because the upper electrode layer 62, which is made of a gold system material containing glass frit, is extending to the side edge portion. Therefore, the resistance value hardly shifts.

Now in the following, actual characteristics of the resistor are compared with those of the conventional.

Both the invented resistors of embodiment 2 and the conventional resistors have been put into a 1000 cycle thermal shock test, one cycle consisting of a −55° C. ambient for 30 min. and a 125° C. ambient for 30 min., and the rate of resistance value shift was measured.

Both the invented resistors of embodiment 2 and the conventional resistors have been put into a test in a corrosive ambient; where, the resistors were stored in a 96° C. ambient for 1000 hours coexisting with an oil containing a 3% sulfur, a 5% chlorine and distilled water, and the rate of resistance value shift was measured.

Table 3 and Table 4 show the results of the thermal shock test and the corrosive ambient test, respectively. As seen from the test results, the rate of resistance value shift among the invented resistors of the present embodiment is smaller than that among the conventional resistors. This may represent that the invented resistors are reliable even in harsh operating environments. Regarding other items of electrical characteristics, the invented and the conventional resistors, both using a gold system material for the electrodes connected with the resistor layer, showed identical results.

TABLE 3

| | (No. of samples: 20) Rate of resistance value shift (%) | | |
|---|---|---|---|
| | Maximum | Minimum | Average |
| Embodiment 2 | 0.10 | −0.03 | 0.05 |
| Conventional | disconnection (5 pcs) | 1.7 | — |

TABLE 4

| | (No. of samples: 20) Rate of resistance value shift (%) | | |
|---|---|---|---|
| | Maximum | Minimum | Average |
| Embodiment 2 | 0.04 | 0.00 | 0.02 |
| Conventional | disconnection (5 pcs) | 3.1 | — |

Figure 5:
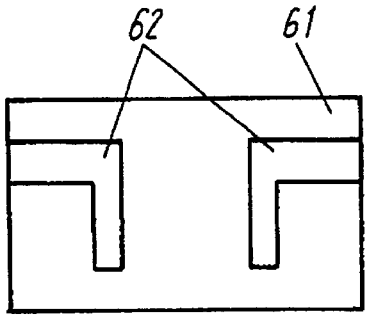
FIG. 5 and FIG. 6 are plane views showing modifications of the upper electrode layer in an invented resistor.
Figure 8:
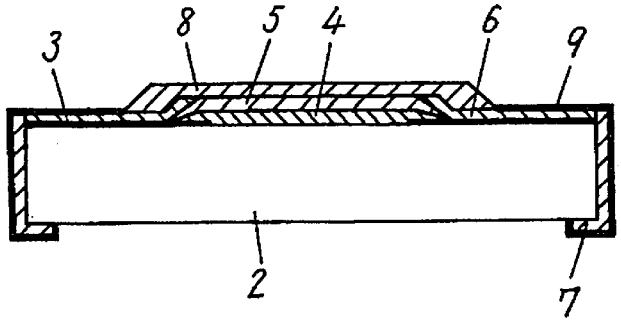
Fig. 8 PRIOR ART
FIG. 8 is a cross sectional view of a conventional resistor.

Although the upper electrode layer 62 has been formed in the shape of a letter T in the present embodiment 2, it may be formed instead in the shape of a letter L, as shown in FIG. 5. This shape may also save the consumption of the precious gold system material, and the manufacturing cost of a resistor may be reduced.

Figure 6:
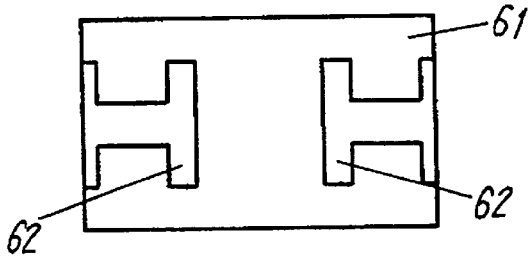

The upper electrode layer 62 may also be formed in the shape of a letter H, as shown in FIG. 6. By so doing, an area which enables the upper electrode layer 62 to have the direct electrical contact, not via the another upper electrode layer 65, increases because of the increased side edge area of upper electrode layer 62. As a result, the reliability in the connection may be improved, and the operational reliability of a resistor in a corrosive environment may be further raised.

Figure 7:
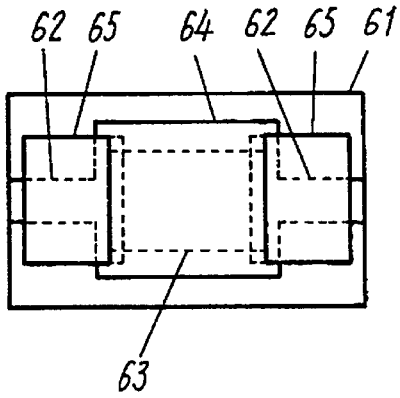
FIG. 7 is a plane view showing an invented resistor in accordance with a modification of embodiment 2.

When the another upper electrode layer 65 is disposed, as shown in FIG. 7, so as the upper electrode layer 62 at the edge portion of the substrate 61 is exposed or uncovered, an area which allows the upper electrode layer 62 to have a direct electrical contact, not via the another upper electrode layer 65, increases. Therefore, the reliability of the connection improves, and the operational reliability of a resistor in a corrosive environment may be further raised.

The protection layer 67 may also be formed with an epoxy group or a phenol group resin, alike the case with embodiment 1. The end face electrode layer may also be formed with a nickel group electro-conductive resin, through a transfer printing method using a roller, or by sputtering a nickel chromium group material. When the protection layer is formed with the above resin material, and the end face electrode layer is formed with the resin or the nickel chromium material, the level of accuracy in the resistance value of a resistor will improve, also the production yield rate may be raised. The lower electrode layer, the end face electrode layer, the barrier layer and the solder layer contribute to a higher mounting reliability. If the end face electrode is provided only in the upper part of the side surface of substrate 61, the fillet of a resistor goes smaller when it is mounted with the protection layer 67 down. This contributes to increase the mounting density.

The present invention can be embodied in various forms, without departing from the spirit or the main feature. For example, although an alumina substrate has been exemplified in the above described embodiments, substrates of other ceramic materials may of course be used for the same purpose. The scope of the present invention is shown by the claims, and not to be restricted by the above explanation. Modifications or changes in the scope of the claims or equivalents thereto are all within the scope of the invention.

What is claimed is:

1. A resistor comprising:

a substrate;

a pair of upper electrode layers comprising a thickness of 5–15 $\mu$m of a conductive material containing gold and 10–30% by volume of glass frit, on both end portions of an upper surface of said substrate;

a resistor layer formed between said pair of upper electrode layers so that a part of said resistor layer overlaps with the respective upper electrode layers;

a protection layer provided to cover at least said resistor layer;

lateral electrode layers electrically connected to said pair of upper electrode layers, on both sides of said substrate; and plating layers covering exposed portions of said pair of upper electrode layers and said lateral electrode layers.

2. The resistor of claim 1, wherein each of said pair of upper electrode layers is formed in the shape of a letter T whose top line is disposed in parallel to and the vertical line is disposed perpendicular to the width direction of said substrate, said top line having contact with said resistor layer, said vertical line being disposed towards the side edge of said substrate.

3. The resistor of claim 1, wherein each of said pair of upper electrode layers is formed in the shape of a letter L whose horizontal line is disposed in parallel to and the vertical line is disposed perpendicular to the width direction of said substrate, said horizontal line having contact with said resistor layer, said vertical line being disposed towards the side edge of said substrate.

4. The resistor of claim 1, wherein each of said pair of upper electrode layers is formed in the shape of a letter H whose pair of vertical lines are disposed in parallel to the width direction of said substrate, one of said pair of vertical lines having contact with said resistor layer while the other vertical line being disposed at the side edge of said substrate.

5. The resistor of claim 1, wherein said protection layer comprises a resin group material.

6. The resistor of claim 1, further comprising an end face electrode layer provided to cover the whole surface of the end face of the substrate or disposed in the upper part of the end face of the substrate, so as to keep electric contact with said pair of upper electrode layers.

7. A resistor comprising:

a substrate;

a pair of upper electrode layers comprising a thickness of 5–15 $\mu$m of a conductive material containing gold and 10–30% by volume of glass frit, on both end portions of an upper surface of said substrate;

a resistor layer formed between said pair of upper electrode layers so that a part of said resistor layer overlaps with the respective upper electrode layers;

a pair of another upper electrode layers above both end portions of said substrate, covering at least a part of the surface of said pair of upper electrode layers, and having electric contact with said pair of upper electrode layers;

a protection layer covering at least said resistor layer;

lateral electrode layers electrically connected to said pair of upper electrode layers, on both sides of said substrate; and plating layers covering exposed portions of said pair of upper electrode layers and said lateral electrode layers.

8. The resistor of claim 7, wherein said another upper electrode layer is formed in the side portion of the surface of said substrate excluding the edge so as to cover a part of said at least one of said pair of upper electrode layers.

9. The resistor of claim 7, wherein said another upper electrode layer comprises an electro-conductive resin material while said protection layer is comprises a resin group material.

* * * * *